US005312283A

United States Patent [19]

Lyman

[11] Patent Number: 5,312,283

[45] Date of Patent: May 17, 1994

[54] FLEXIBLE TOY CONSTRUCTION BLOCKS

[76] Inventor: Ronald L. Lyman, 235 Cascade Falls Dr., Folsom, Calif. 95630

[21] Appl. No.: 808,180

[22] Filed: Dec. 13, 1991

[51] Int. Cl.[5] ..... A63H 33/08

[52] U.S. Cl. ..... 446/95; 446/120; 446/107; 446/128

[58] Field of Search ..... 446/95, 120, 107, 128, 446/121, 117, 109, 124, 125

[56] References Cited

U.S. PATENT DOCUMENTS

| | | | |
|---|---|---|---|
| 419,099 | 1/1890 | Arold | 446/121 |
| 2,845,748 | 8/1958 | Derham | 446/368 |
| 3,206,888 | 9/1965 | Litzka | 446/107 |
| 3,496,670 | 2/1970 | Sloop et al. | 446/104 |
| 3,777,393 | 12/1973 | Baer | 446/128 X |
| 3,780,469 | 12/1973 | Hancovsky | 446/127 |
| 3,996,692 | 12/1976 | Daenen | 446/95 X |

*Primary Examiner*—Mickey Yu
*Attorney, Agent, or Firm*—Bernhard Kreten

[57] ABSTRACT

A set of similar interconnectable flexible toy construction blocks. Each block has three different attachment surfaces. Posts on a top surface connect within rims on a bottom surface for vertical stacking of the blocks. A projection on a front end connects within a complementally shaped receiver on a rear end for horizontal connecting of the blocks. An interior of the projection is complementally shaped to the posts on the top surface, allowing the front end of one block to connect to the top surface of another block. Each block has two directions of flexibility. Horizontal flexibility is provided by dividing the block into separate segments divided by gaps. Each gap is spanned by a thin web. The gaps can change shape when bending forces are applied, causing the block to flex horizontally. Vertical flexibility is provided by hollowing out each segment of the block through one surface, preferably the bottom. The walls of the segments can flex towards each other or away from each other when bending forces are applied, causing the block to flex vertically.

25 Claims, 6 Drawing Sheets

FLEXIBLE TOY CONSTRUCTION BLOCKS

FIELD OF THE INVENTION

The following invention relates generally to an instrumentality formed from a plurality of blocks for creating objects of amusement for children. Blocks are interconnected such that they stimulate a child's imagination and creativity. More specifically, the blocks are flexible in a controlled manner. This facilitates creation of structures having surfaces which can be deformed and curved and which can be easily changed in shape.

BACKGROUND OF THE INVENTION

Sets of building blocks of various shapes and with various methods of interconnection are well known in the art. Some basic building blocks are of very simple construction and are interconnectable in a multitude of different ways. Other building blocks are more specialized and are designed to allow creation of a more limited variety of structures.

One property surprisingly rare among basic building blocks is flexibility. A few blocks have flexible connections between other similar blocks, but such blocks cannot actually flex integrally when standing alone. The blocks of the instant invention exhibit integral flexibility without having to first be connected to other blocks.

Many toys known in the art exhibit flexibility, but these toys do not provide the creative medium provided by basic, interconnectable building blocks. The blocks of this invention combine flexibility with connectability and simplicity, enabling the child-user to create structures so that the child can also enjoy the attractiveness inherent in flexible toys.

The following patents reflect the state of the art of which applicant is aware. These patents are included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| INVENTOR | PAT. NO. | ISSUE DATE |
|---|---|---|
| Schmetzer | 171,533 | December 28, 1875 |
| Lewis | 1,405,851 | February 7, 1922 |
| Hultman | 1,554,095 | September 15, 1925 |
| Andre | 2,649,803 | August 25, 1953 |
| McKee | 2,708,329 | May 17, 1955 |
| Aureillan | BR740,951 | November 23, 1955 |
| Zimmerman | 2,776,521 | January 8, 1957 |
| Grutta | 2,972,833 | February 28, 1961 |
| Christiansen | 3,005,282 | October 24, 1961 |
| Amsler | 3,032,919 | May 8, 1962 |
| Christiansen | 3,162,973 | December 29, 1964 |
| Wright, et al. | 3,224,135 | December 21, 1965 |
| Christiansen | 3,242,610 | March 29, 1966 |
| Stubbmann | 3,392,480 | July 16, 1968 |
| Playcraft Toys, Inc. | BR1,167,678 | October 22, 1969 |
| Sloop et al. | 3,496,670 | February 24, 1970 |
| Shackelton | BR1,212,537 | November 18, 1970 |
| Huebl | 3,603,025 | September 7, 1971 |
| Zimmerman | 3,604,145 | September 14, 1971 |
| Schmidt | 3,699,709 | October 24, 1972 |
| Nagasaka | 3,740,895 | June 26, 1973 |
| Bakker | DT2,429,491 | January 16, 1975 |
| Lange | 3,867,784 | February 25, 1975 |
| Retzler & Knight | BR1,382,134 | January 29, 1975 |
| Crawley | 3,894,354 | July 15, 1975 |
| Fabre | 3,895,456 | July 22, 1975 |

-continued

| INVENTOR | PAT. NO. | ISSUE DATE |
|---|---|---|
| Much | 3,975,858 | August 24, 1976 |
| Harvey | 4,055,019 | October 25, 1977 |
| Osterried | 4,080,742 | March 28, 1978 |
| Hake | 4,090,322 | May 23, 1978 |
| Kristiansen | 4,185,410 | January 29, 1980 |
| Knudsen | 4,214,403 | July 29, 1980 |
| Mayr | 4,253,268 | March 3, 1981 |
| Davis | 4,257,207 | March 24, 1981 |
| Xanthopoulos, et al. | 4,270,303 | June 2, 1981 |
| Bersani | FR2534-484-A | April 20, 1984 |
| Inskip | EP-109-181-A | May 23, 1984 |
| Lyman | 4,606,732 | August 19, 1986 |
| Yoke | 4,642,064 | February 10, 1987 |
| Ziegler | 4,731,041 | March 15, 1988 |
| Lyman | 4,764,144 | August 16, 1988 |
| Lyman | 4,789,369 | December 6, 1988 |
| Svagerko | 4,792,319 | December 20, 1988 |
| Heiremans | EP-89/00069 | January 12, 1989 |
| Blickle | 4,932,916 | June 12, 1990 |

The patent to Wright teaches the use of a rigid building block set whose block elements can be interconnected using flexible hitches. The Wright patent also has wheels connectable to the blocks. The invention of the instant application is distinguishable over Wright in that the present invention features internally and integrally formed flexible blocks. Furthermore, the instant blocks have, inter alia, top and bottom attachment surfaces, allowing much more freedom in creating unique structures than do the blocks of the Wright patent.

The patent to Lyman (U.S. Pat. No. 4,606,732), the instant inventor, and dated Aug. 19, 1986, teaches the use of a block having top and bottom attachment surfaces and front and rear attachments that flexibly interconnect. However, this Lyman patent has rigid blocks unlike the invention of this application. The present invention is further distinguishable from the Lyman patent of 1986 in that it is internally flexible about plural axes, rather than the single axis of flexibility exhibited by the combination of separate blocks shown in this patent.

The Zimmerman patent teaches the use of flexible strips and not blocks like the present invention. The Zimmerman patent also merely teaches but one mode of interconnection while the invention of this application has plural modes of interconnection. Thus, the present invention is clearly distinguishable from the patent to Zimmerman.

The remaining prior art listed generally above, but not specifically distinguished from the invention of this application, diverge more starkly from the present invention than those specifically distinguished above.

SUMMARY OF THE INVENTION

This invention provides a unique form of toy construction block. Multiple blocks formed according to the instant invention can be combined in a variety of interesting ways to stimulate the imagination of the user.

Preferably, each block has three modes of interconnection for coupling to other similar blocks. Also, each block is preferably flexible in two distinct geometric planes. Thus, block assemblies can be erected having a variety of patterns including patterns with curved surfaces.

While the complexity attainable from some block combinations is significant, the blocks can also be stacked and interconnected in many basic ways, providing a creativity medium for children of a variety of skill levels. The blocks are made of substantially rigid, load bearing material and of a basic orthorhombic shape making them easily stackable. The blocks have secure fastening means for stable linkage of separate blocks. The flexing means is primarily designed into the blocks for the desired level and direction of flexibility, rather than merely choosing materials of a desired elasticity. These features combined in a single block allow the block to be utilized in a wide variety of ways of varying complexity.

The three interconnection modes may be described in conjunction with the following structure. Four of the six sides of the blocks may have an interconnecting accessory attached thereto. A top surface has rows of square posts. A bottom surface has rectangular rims which circumscribe blind bores. A front end has a square projection. A rear end has a square receiver dimensioned to receive the projection.

The first interconnection mode is provided by placing the top surface of one block adjacent to the bottom surface of another block. The rectangular rims around the blind bores are of similar width to the width of the posts, allowing the rows of posts to frictionally fit within the blind bores. Each block has a similar number of rows of posts as it has blind bores. The blind bores are spaced a distance apart equal to the distance between adjacent posts of a single row of posts, allowing the blocks to stack when one block is rotated any multiple of 90°.

The second interconnection mode is provided by juxtaposing the front end of one block adjacent to the rear end of another block. The shape of the receiver is complemental to the shape of the projection, allowing the projection to fit within the receiver and to be retained therein. Each projection has detents on one or more of its sides which help restrain the projection from slipping out of the receiver which has recesses, of complemental shape to the detents, on some or all of its interior side walls. Because the projection is square, the adjacent blocks can be interconnected by this second mode in four rotationally distinct relative orientations. The detents may be hemispherical in shape and frictionally fit within the recesses.

The third interconnection mode is provided by juxtaposing the front end of one block adjacent to the top surface of another block. The projection has a square cross-sectioned hollow interior which is exposed at a forwardmost surface of the projection. The hollow interior is similar in shape to each of the posts of the top surface. Thus, a post of one block can fit frictionally within the interior of the projection of another block. Because the interior is square, the adjacent blocks can be interconnected by this third mode in four rotationally distinct relative orientations.

The blocks are designed for flexibility within two separate orthogonal planes. Each direction of flexibility is provided by a distinct set of carefully designed flexing features.

A first direction of flexibility within a horizontal plane allows the front end of the block to yaw with respect to the rear end. Stated alternatively, it allows the block to flex around a vertical axis orthogonal to the top surface and the bottom surface of the block where the top and bottom surfaces are oriented in horizontal planes.

This primary horizontal flexing feature of the blocks is made possible by a plurality of vertically-disposed, parallel gaps which divide the blocks into a series of segments which reside in adjacent parallel vertical planes. The projection is attached to a forwardmost segment in this series. The receiver is attached to the rearward most segment in this series. Each segment is connected to adjacent segments by a web fixedly attached therebetween. Each web is located at a gap. The web is a rectangular planar construct extending from the top surface to the bottom surface, oriented in a vertical plane with the web being thin enough to allow some flexing by yawing about the vertical axis as mentioned in the last paragraph. However, the web is thick enough to securely bind the adjacent segments together.

When a bending force is applied to one block about the vertical axis, the gaps are altered in shape by flexing the webs. Along one side surface the gaps are reduced in width until adjacent segments abut. Along an opposite side surface the gaps are expanded in width. The gaps, thus deformed, take on a wedge-shaped appearance and the segments are rotated into planes which slightly diverge from a mutually parallel orientation.

When a series of blocks are interconnected with the projections and receivers, a pronounced curve is more readily perceivable. Even complete circles may be constructed when a sufficient number of blocks are interconnected.

A second direction of flexibility within a vertical plane allows the front end of the block to pitch with respect to the rear end. Stated alternatively, it allows the block to flex around a horizontal axis orthogonal to the side surfaces of the block.

Thus, this pitching motion may be viewed as up-and-down movement while the previously discussed yawing motion was side-to-side.

This primary vertical flexing feature (pitching) of the blocks is made possible primarily by distortion of the blind bores mentioned above. Each of the segments has one blind bore formed on the bottom surface. The blind bores each define a hollow orthorhombic interior within each segment. Each blind bore segment is defined by a top wall, two side walls and two inside end walls. These end walls face the gaps that have the webs. Each of the walls is thin enough to be slightly flexed.

When a bending force (pitching) is applied about an axis which extends perpendicular to the side surfaces of the block, the blind bores of each segment are altered in shape. The top surface acts as a shear wall restricting expansion or contraction of the blind bore's width on an upper side while the absence of any shear wall on the bottom surface allows the blind bore to deform somewhat by expanding or contracting. Thus, the length of the block along the top surface is held substantially constant while the length of the block along the bottom surface is modifiable due to flexing of the block at that area by distorting the rim of the blind bore. Thus, the blind bore's cross-section is modified somewhat from remaining rectangular due to the bending forces. Typically, the blind bore becomes either constricted or expanded along a central long axis depending on the direction of distortion.

When a series of blocks are serially interconnected along the projection and the receiver of each block, a more pronounced curve can be formed. Even complete circles may be constructed when a sufficient number of blocks are interconnected.

A secondary block is provided having substantially the same structure as the above-described blocks, but is shorter in length, having fewer segments and therefore fewer webs.

All blocks have a substantially circular-shaped recess defining an axle mount on side surfaces thereof. Each mount is a hollowed out opening on a lower end of a central segment's side surface. The mounts are sized to receive a cylindrical axle therewithin in a manner allowing the axle to rotate, but restricting the axle from translation without a significant force being applied. Attached to both ends of the axle are wheels. When a wheel-axle assembly is located within the mounts of the blocks, the block can then roll on a flat surface. When a plurality of blocks are interconnected having the wheel-axle assembly within the mounts, a chain of blocks can be rolled along a hard surface. This configuration allows a set of blocks to approximate the function of a toy train or car set.

The unique combination of flexibility and multiple attachment means in a basic building block toy construction set provides unique advantages not found in previously existing devices.

OBJECTS OF THE INVENTION

Accordingly, it is a primary object of the present invention to provide a novel and useful construction toy set formed from flexible interconnectable building blocks.

A further object of the present invention is to provide a device as characterized above which is extremely simple to use thereby appealing to users having a modest skill level, but also capable of manipulation by extremely creative people thereby spanning a broad spectrum in maintaining interest of users.

A further object of the present invention is to provide a device as characterized above which is both visually and tactilely stimulating.

It is yet a further object of the present invention to provide a device as characterized above which is extremely durable in construction, safe to use, and lends itself to mass production techniques.

A further object of the present invention is to provide a device as characterized above which is dimensioned such that even young children can safely play with blocks forming the construction toy set.

A further object of the present invention is to provide a device as characterized above where blocks can be interconnected in a multiplicity of ways, thereby promulgating creativity and providing an extremely large number of possible structures buildable with this construction toy set.

A further object of the present invention is to provide a device as characterized above which flexes in a multiplicity of ways, thereby enhancing creativity in construction and in use of constructed structures.

A further object of the present invention is to provide a device as characterized above where flexibility is obtained in a block made of substantially rigid material, thereby providing stability and inherent durability to the blocks.

Viewed from a first vantage point it is an object of this invention to provide a flexible toy building block having a top surface, a bottom surface, a first front end and a second rear end comprised of a means for vertically stacking said building block to a similar building block, means for horizontally connecting said building block to a similar building block, and means for flexing said building block; whereby a versatile building block is created which can be combined with other similar blocks in a multitude of unique and original ways, providing the user with a medium for exercising creativity and improving various developmental skills.

Viewed from a second vantage point it is an object of the present invention to provide a polygonal flexible toy block having a substantially orthorhombic structure comprised of means for flexing said block about both a first axis and a second axis perpendicular to the first axis, and means for interconnecting said flexible block to a similar flexible block; whereby a block is created which can flex in a variety of unique ways and interconnect with other similar blocks to provide the user with a toy for education and amusement.

Viewed from a third vantage point it is an object of the present invention to provide a set of interconnectable flexible blocks of similar construction comprised of means for interconnecting a series of said blocks together and means for flexing said blocks; whereby a series of said blocks can be formed into a chain through serial interconnection by a user allowing the user to create enjoyable structures from said blocks.

These and other objects will be made manifest when considering the ensuing description coupled with the drawings.

DESCRIPTION OF THE DRAWING FIGURES

DESCRIPTION OF PREFERRED EMBODIMENTS

Figure 1:
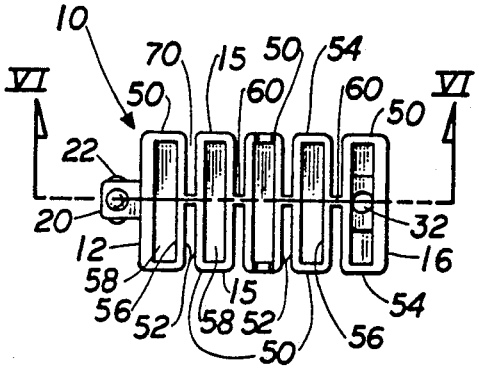
FIG. 1 is a bottom plan view of a single block of this invention.

Referring now to the drawing figures wherein like numerals represent like parts throughout, FIGS. 1 through 6 show details of a primary toy construction block designated by reference numeral 10. Each primary block 10 is interconnectable to similar blocks 10 (or other blocks to be described infra) through three different modes of interconnection. Each primary block 10 is also flexible along arrows "A" of FIG. 5, about a vertical axis Z (FIG. 3) to facilitate "yawing". Each block is also flexible about a horizontal axis Y (FIG. 4) to facilitate "pitching" along arrows "B" of FIG. 3.

In essence, the block 10 is formed as a six-sided orthorhombic construct having a first front end 12, a second rear end 16, a top surface 14, a bottom surface 18 and two side surfaces 15. Each front end 12 is attachable to the rear end 16 of an adjacent block 10. Each top surface 14 is attachable to the bottom surface 18 of an adjacent block 10. Each front end 12 is also attachable to the top surface 14 of an adjacent block 10. These attachments define the three interconnection modes of a plurality of primary blocks 10.

Each block 10 is divided into a plurality of discreta segments 50 separated by a plurality of parallel, planar gaps 70. Each segment 50 is preferably connected to adjacent segments 50 by a plurality of vertical webs 60 spanning the gaps 70. The webs 60 are narrow enough to allow the separate segments 50 to flex along arrow A, shown in FIG. 5, relative to each other and about a vertical axis Z (shown in FIG. 4 e.g.) which is perpendicular to the top surface 14 and the bottom surface 18. These characteristics define the horizontal flexing means of the block 10.

Each segment 50 has a blind bore 58 on the bottom surface 18 which gives the segment 50 a hollow orthorhombic structure. The blind bore 58 is surrounded by a rim 56 on the bottom surface 18. The blind bore 58 is bounded and therefore defined by five surfaces and is open on the bottom surface 18. Thus, when bending forces are applied to the block 10 about a "horizontal" axis Y (e.g. FIG. 4) perpendicular to the side surfaces 15, the blind bore 58 is deformed allowing the block 10 to flex vertically along arrow B, shown in FIG. 3. These characteristics define the vertical flexing means of the block 10.

Thus, the blocks 10 are interconnectable in three separate ways and the blocks 10 are flexible about two separate axes Y, Z. Each interconnection mode provides a joint between separate blocks 10 for construction of multiple block 10 assemblies.

The first front end 12 attaches to the second rear end 16, with several permutations illustrated in FIGS. 16 and 18A through 22. The first front end 12 of each block 10 has a square cross-sectioned projection 20 extending outwardly and perpendicularly therefrom. The projection 20 is located centrally on the front end 12.

The second rear end 16 of each block 10 has a square cross-sectioned receiver 30 thereon which extends inwardly and perpendicularly from the rear end 16. The receiver 30 is located centrally on the second rear end 16 of the block 10. The receiver 30 is of equal size and depth as the size and length of the projection 20. Thus, when two separate blocks 10 are oriented with the front end 12 of one block 10 and the rear end 16 of another block 10 adjacent to each other, the projection 20 of the front end 12 mates within the receiver 30 of the rear end 16.

The projection 20 has four sides which surround and define a hollow interior 26. Each side of the projection 20 has a detent 22. The detent 22 is a convex construct which extends out from the sides of the projection 20. However each receiver 30 preferably has only two recesses 32 and located on two opposite sides of the receiver 30. The recesses 32 are holes of diameter similar to the width of the detents 22. The recesses 32 are located a distance from the rear end 16 equal to the distance from the detents 22 to the front end 12.

When the projection 20 of one block is positioned within the receiver 30 of another block, two of the detents 22 reside within the recesses 32, holding the projection 20 in place and therefore also the two blocks. The receiver 30 has notches 34 on sides of the receiver 30 without recesses 32. The notches 34 are rectangular indentations in the walls of the receiver 30 which allow the detents 22 of the projection 20 to pass without substantial interference.

Because the projection 20 and the receiver 30 are of similar, substantially square cross-section, the projection 20 can fit within the receiver 30 in four rotationally distinct configurations. This is shown in FIGS. 18A through 18D, with rotation occurring about a second horizontal axis X.

Figure 16:
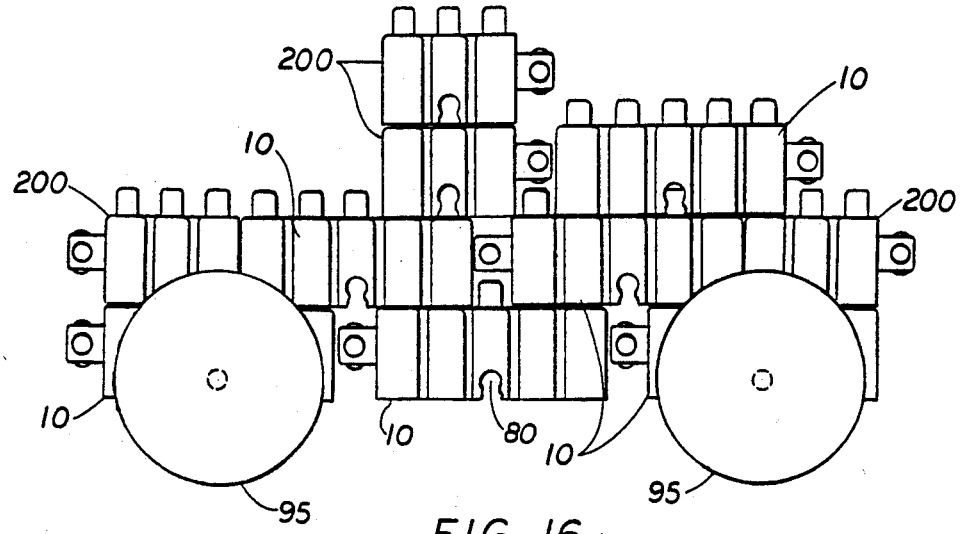
FIG. 16 is an elevational view revealing a possible sequence of block interconnection.
Figure 17:
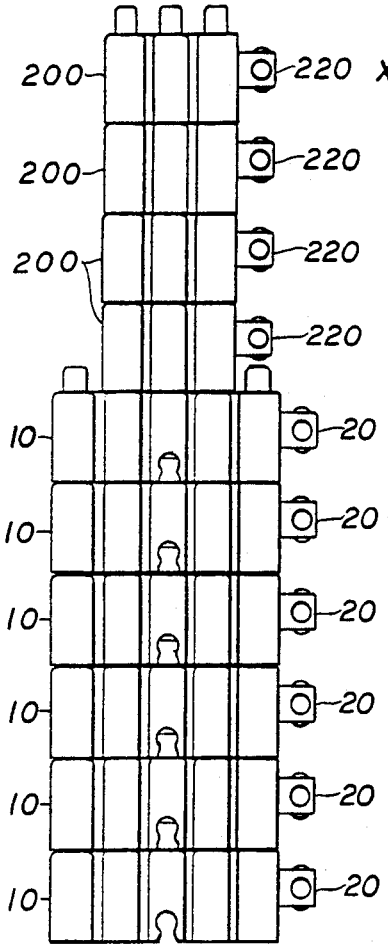
FIG. 17 is an elevational view revealing another possible sequence of block interconnection.
Figure 18A:
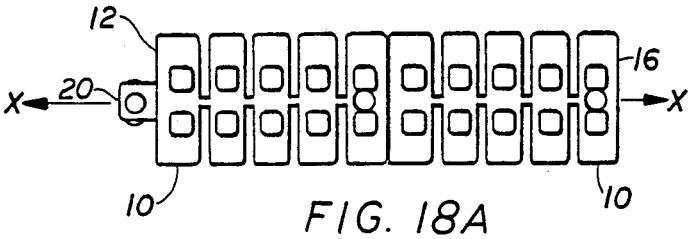
FIG. 18A is an elevational view revealing various block interconnections.
Figure 18B:
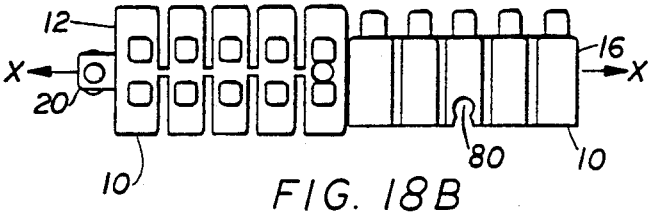
FIG. 18B is an elevational view revealing various block interconnections.
Figure 18C:
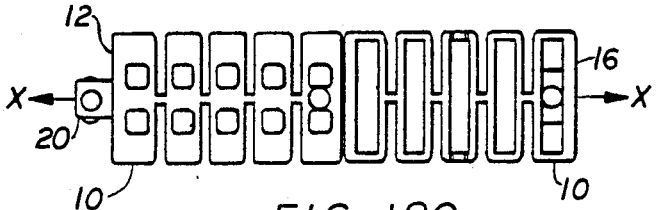
FIG. 18C is an elevational view revealing various block interconnections.
Figure 18D:
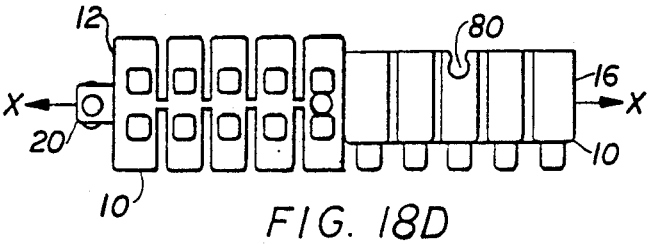
FIG. 18D is an elevational view revealing various block interconnections.
Figure 20:
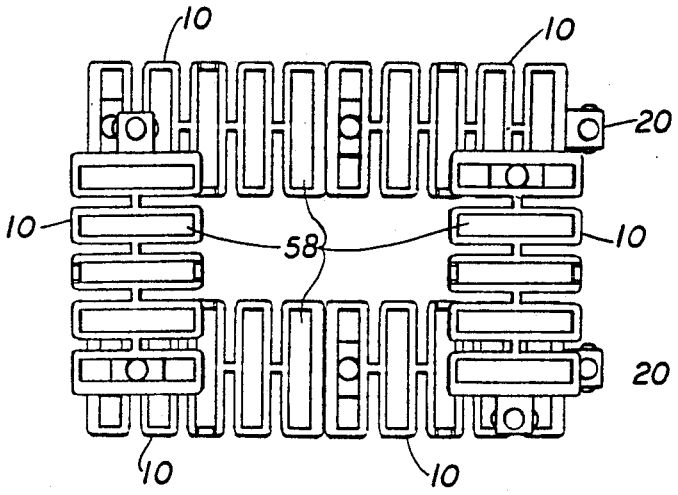
FIG. 20 is a bottom plan view of a plurality of blocks in another form of interconnection.

The top surface 14 attaches to the bottom surface 18, as shown in FIGS. 16, 17, and 20. Each top surface 14 has a plurality of posts 40 configured in rows 44 such that there is one row 44 on each segment 50 of the block 10. The posts 40 are square cross-sectioned constructs which extend vertically upwardly from the top surface 14. Preferably each row 44 has two posts 40 therein. Preferably the block 10 has five segments 50.

Each bottom surface 18 has a plurality of rectangular rims 56 such that there is one rim 56 on a bottom of each segment 50 of the block 10. The rims 56 are rectangularly cross-sectioned constructs having a short dimension equal to the width of the posts 40 and a long dimension greater than the length of the rows 44. The blind bores 58 which the rims 56 circumscribe, are deeper than the length of the posts 40.

When two similar blocks 10 are oriented with one block's top surface 14 adjacent to another block's bottom surface 18, the two blocks 10 interconnect by having the rims 56 of one block 10 fit frictionally over the rows 44 of posts 40 of the other block 10. Alternatively, the rims 56 of one block 10 may fit over posts 40 of separate rows 44 of adjacent segments 50. The distance between adjacent rims 56 is preferably equal to the distance between adjacent posts 40 of the same row 44, allowing the rims 56 of one block 10 to attach to posts 40 of another block 10 when the two blocks 10 are rotated a multiple of 90° relative to each other. This ability to rotate is shown in FIG. 20. Note how the rotation in 90° increments occurs about the vertical axis Z shown in FIGS. 4 and 6.

Figure 23:
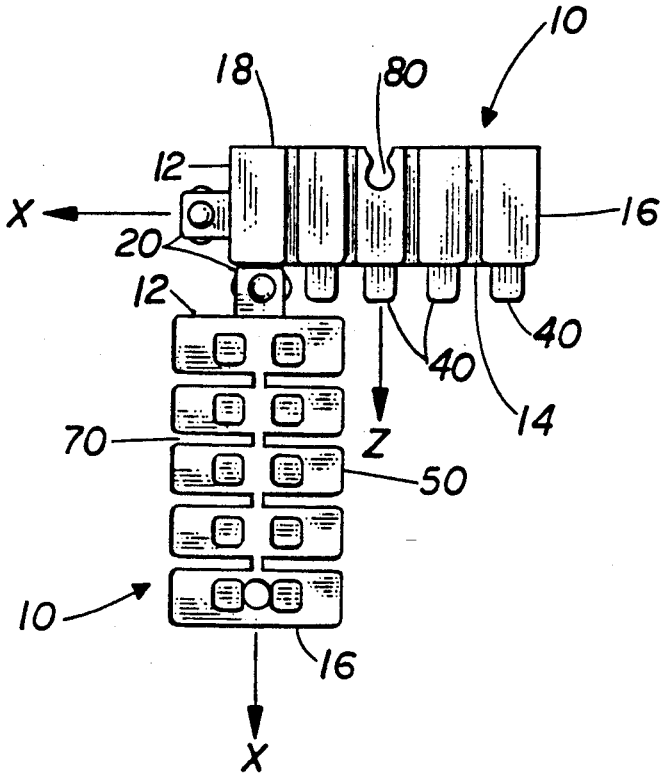
FIG. 23 is a depiction of a possible sequence of block interconnection.

The front end 12 is also attachable to the top surfaces 14, as shown in FIG. 23. Each projection 20 has a hollow interior 26. The interior 26 is enclosed on four sides by side walls of the projection 20 and on one side by the front end 12. The forwardmost side of the projection 20 opens into the interior 26. The interior 26 has a square cross-section similar in shape to the cross-section of the posts 40 of the top surface 14 of the block 10. When the front end 12 of one block 10 is oriented adjacent to the top surface 14 of another block 10, the interior 26 of the projection 20 of one block 10 fits frictionally over one of the posts 40 of the other block 10, as shown in FIG. 23. Because the interior 26 and each of the posts 40 are square in cross-section, the two blocks 10 may be attached in four distinct orientations by rotating one block 10 a multiple of 90° relative to the other block 10, rotation occurring about either the second horizontal axis X or about the vertical axis Z, shown in FIGS. 4, 6 and 23.

As mentioned, each block 10 is preferably flexible about two separate and mutually orthogonal axes Y, Z. A series of interconnected blocks 10 exhibit enhanced curvature in some cases due to addition of the curve of each block 10 to the series of interconnected blocks 10.

Figure 1A:
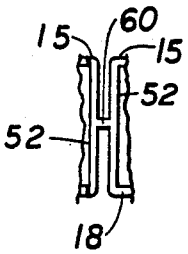
FIG. 1A is a cut-away bottom plan view of the FIG. 1 single block in a first, relaxed position.
Figure 14:
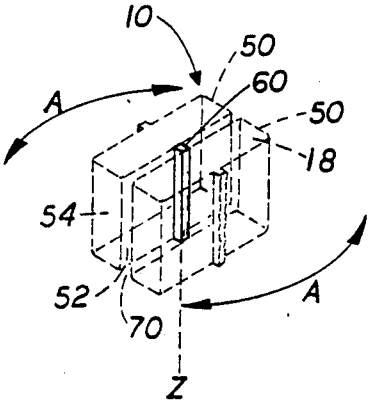
FIG. 14 is an exemplary isometric view of a portion of a FIG. 1 or 12 block revealing block flexibility means.
Figure 19:
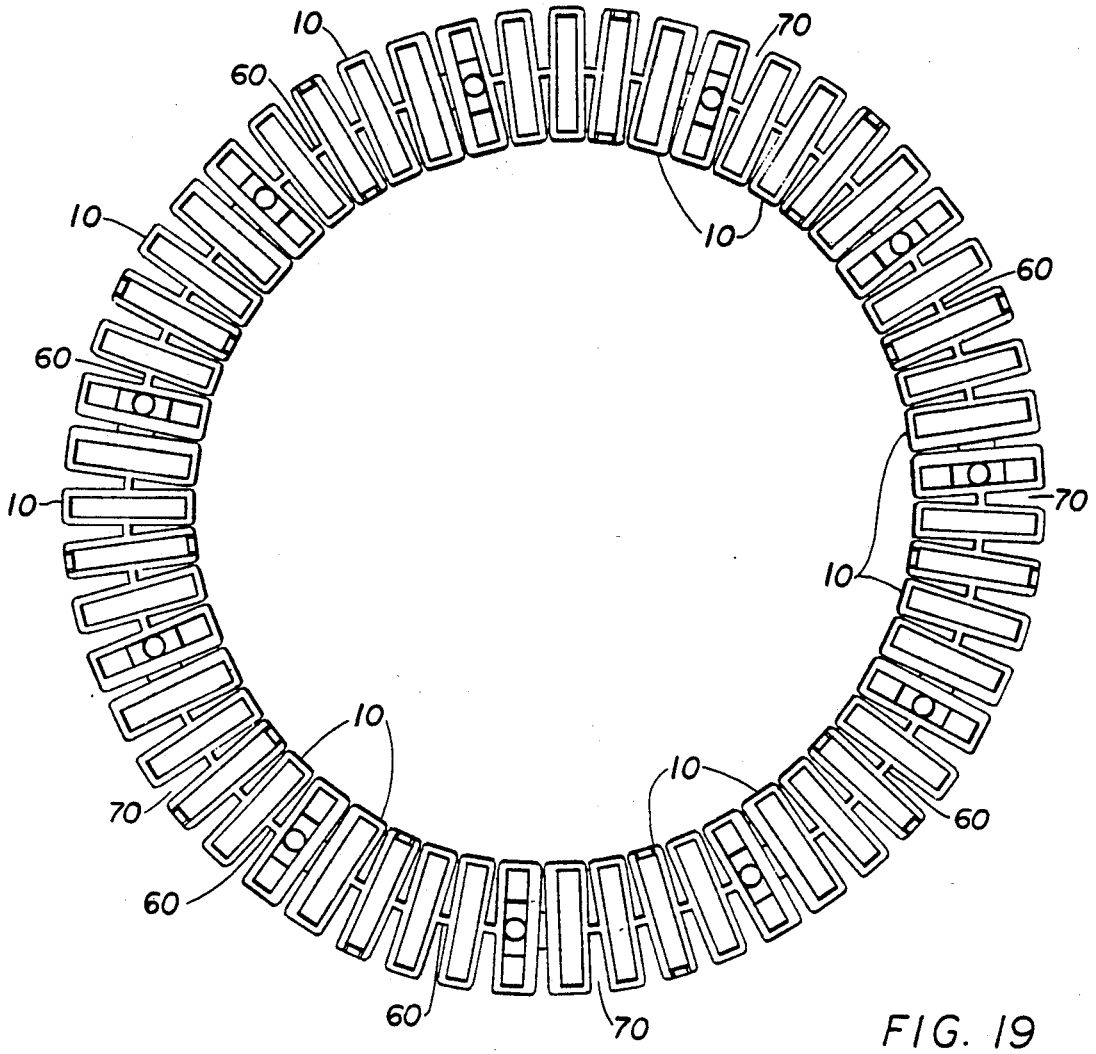
FIG. 19 is a bottom plan view of a plurality of blocks in one form of interconnection.
Figures 21, 22:
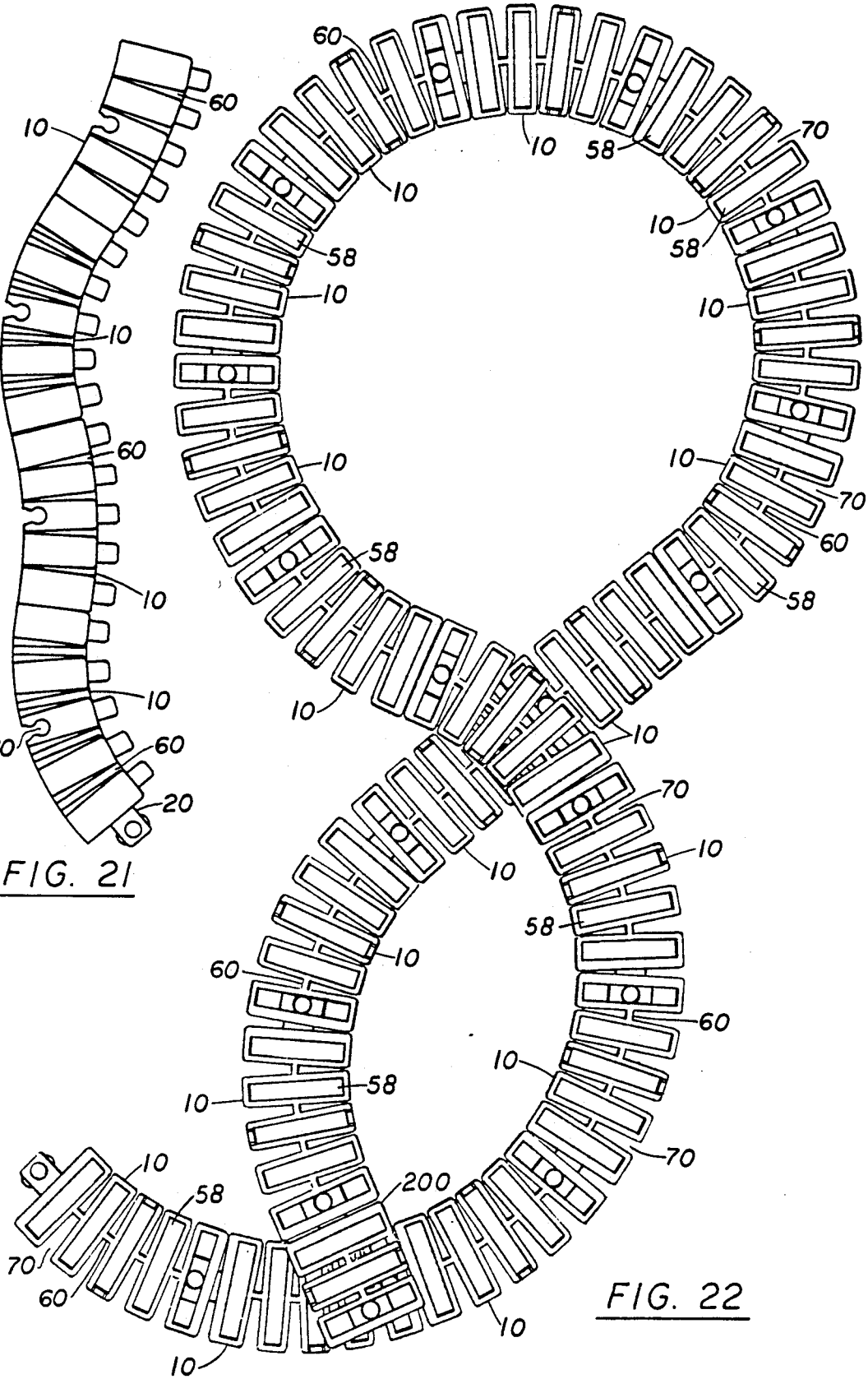
FIG. 21 is a front view of a plurality of blocks in one form of interconnection.
FIG. 22 is a bottom plan view of a plurality of blocks in another form of interconnection.

A first flexing means facilitates flexing, as shown in FIGS. 14, 19 and 22 of the block 10 horizontally about the vertical axis Z. Each block is divided into a plurality of discrete segments 50 separated by a plurality of planar parallel gaps 70. Each segment 50 is an orthorhombic construct with posts 40 on the top surface 14, the rim 56 on the bottom surface 18 and the blind bore 58 on an interior thereof. Each segment 50 is preferably connected to adjacent segments 50 by a plurality of vertically oriented webs 60 spanning the gaps 70. See FIG. 1A. The webs 60 are planar constructs preferably parallel to the side surfaces 15. Each web 60 has marginal edges. These marginal edges connect adjacent segments 50 where two inside walls 52 face each other.

Figure 1B:
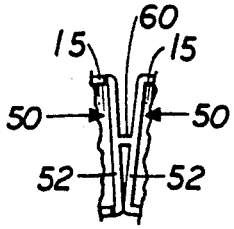
FIG. 1B is a cut-away bottom plan view of the FIG. 1 single block in a second, flexed position.
Figure 2:
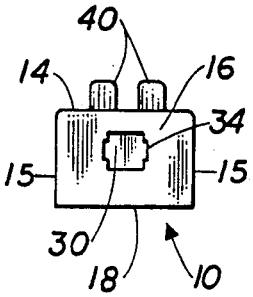
FIG. 2 is a left-side view of the FIG. 1 single block showing a rear end.
Figure 5:
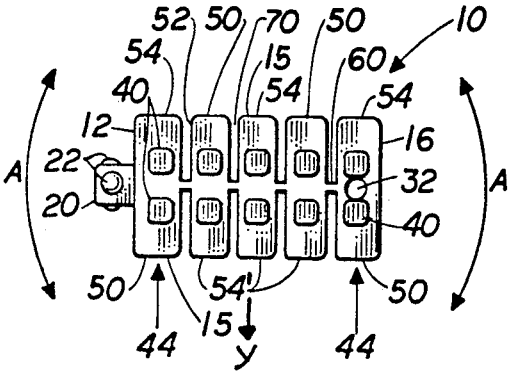
FIG. 5 is a top plan view of the FIG. 1 single block.
Figure 6:
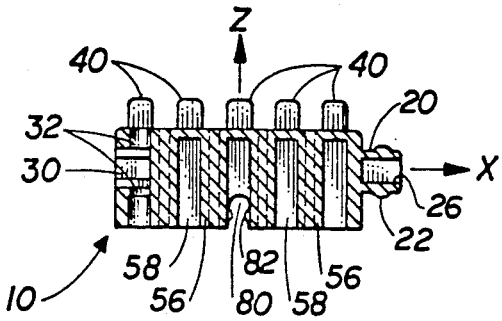
FIG. 6 is a cross-section taken along line VI—VI of FIG. 1 revealing interior details of the block.
Figure 7:
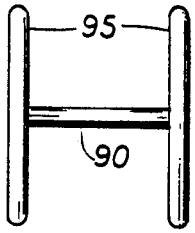
FIG. 7 is a side view of a wheel-axle assembly of this invention.
Figure 8:
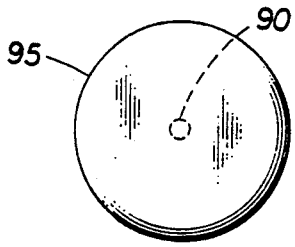
FIG. 8 is a front view of that which is shown in FIG. 7.

The webs 60 are narrow enough to allow the separate segments 50 to flex along arrow A, shown in FIGS. 5 and 14, relative to each other about the vertical axis Z which is perpendicular to the top surface 14 and the bottom surface 18. The block 10 can continue to flex until a corner existing between the inside wall 52 and the side surfaces 15 of one segment 50 contacts another similarly formed corner of an adjacent segment 50 as shown in FIG. 1B. When flexed to this extent, the gaps 70 are transformed from having a constant width to being wedge-shaped in cross-section with no width on one side and approximately double the width on another side. See FIG. 1B. If enough blocks are interconnected through the projection 20 and the receiver 30, a set of blocks 10 can form an entire circle, as shown in FIG. 19. Other unique shapes can also be formed.

Figure 4:
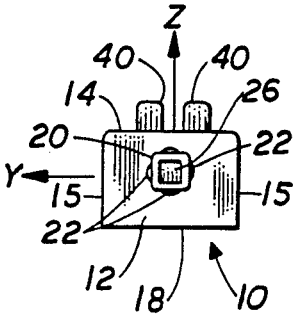
FIG. 4 is a right-side view of the FIG. 1 single block showing a front end.

A second flexing means facilitates flexing of the block 10 vertically about the horizontal axis Y, as shown in FIGS. 4 and 5. The blind bore 58 within each segment 50 is orthorhombic in shape and defined by two parallel inside walls 52, two parallel side walls 54, and the top surface 14. The boundary of the blind bore 58 opposite the top surface 14 is opened and outlined by the rim 56.

Figure 3:
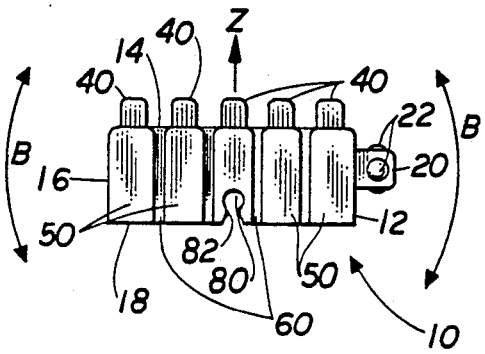
FIG. 3 is a front view of the FIG. 1 single block.

Because the blind bore 58 has no shear wall opposite the top surface 14 (i.e. along the bottom surface 18 of the block 10), the blind bore 58 is deformable in the manner facilitating vertical flexing of the block 10 caused by bending forces along arrows B in FIG. 3. Before any bending force is applied to the block 10, each blind bore 58 is rectangular in cross-section taken in a plane parallel to the side surfaces 15. The rectangle is defined by inside walls 52, top wall 14 and rim 56 surrounding the blind bore's open lower surface. When bending forces "B" shown in FIG. 3 are applied (i.e. about the horizontal axis Y perpendicular to the side surfaces 15 shown in FIGS. 4 and 5) the blind bores 58 are deformed in one of two ways shown in FIGS. 3B and 3C.

Figure 3A:
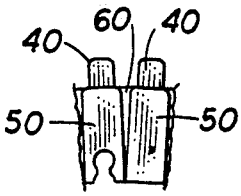
FIG. 3A is a cut-away front view of the FIG. 1 single block in one flexed position.
Figure 3B:
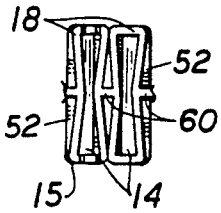
FIG. 3B is a cut-away bottom plan view of the FIG. 1 single block reflecting the flexing shown in FIG. 3A.
Figure 3C:
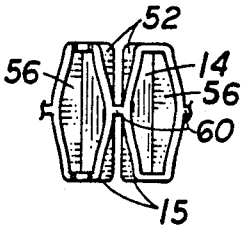
FIG. 3C is a cut-away bottom plan view of the FIG. 1 single block showing a flexure opposite from FIGS. 3A and 3B.

In one way, the lower ends of the inside walls 52 can be forced closer together causing a central portion of one side of each of the rims 56 (adjacent web 60) to approach the other side of each of the rims 56, changing the rectangular cross-sections of the blind bores 58 into an "hourglass or bow tie" shape (FIG. 3B). Flexed in this way, the block 10 becomes curved with the bottom surface 18 shorter than the top surface 14. This is because the lower portion of web 60 forces walls 52 to deform so that the gap 70 between adjacent segments 50 are somewhat triangular as shown in FIG. 3A. This distortion (about the "Y" axis) caused by bending force "B", is illustrated in FIG. 21.

In the second way, the lower end of the inside walls 52 can be forced apart causing one side of each of the rims 56 to be moved away from the other side of each of the rims 56. This distorts the "at rest" rectangular cross-sections of the blind bores 58 into a rim 56 having bulbous inside walls 52 with linear side walls 54 (shown in FIG. 3C) because web 60 forces walls 52 outwardly. Flexed in this way, the block 10 becomes curved with the top surface 14 shorter than the bottom surface 18. As the blocks 10 are serially interconnected with the projection 20 and receiver 30 the curvature of the set of blocks 10 becomes more pronounced (demonstrated in FIG. 21). As shown in FIG. 21, when viewed from the side, a somewhat "serpentine" structure is created.

In use and operation, a set of the blocks 10 can be flexed and interconnected to provide an unlimited variety of creative designs and structures. Long weaving structures such as that shown in FIG. 22 are possible as well as many other structures not shown.

Referring now to FIGS. 3, 7 through 9 and 16, an accessory to the block 10 is shown. Both side walls 54 of one of the segments 50, preferably in the middle of the block 10, have an axle mount 80 located adjacent to the rim 56 along the bottom surface 18 (shown in FIG. 3). Each axle mount 80 is defined by a cut-out portion of the side wall 54 with a shape which converges to a neck 82 and then diverges and converges together in a circular fashion.

Figure 9:
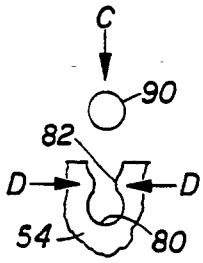
FIG. 9 is a front view of the axle and a portion of the single block revealing details of axle attachment.
Figure 10:
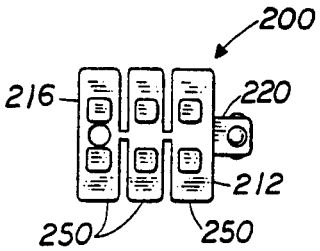
FIG. 10 is a top plan view of a secondary block.
Figure 11:
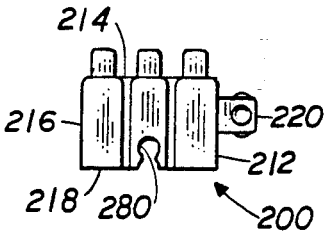
FIG. 11 is a front view of the FIG. 10 secondary block.

An axle 90 of a diameter slightly larger than the width of the neck 82 and only slightly smaller in width to the circular convergence of the mount 80 is provided. The axle 90 is long enough to extend through two mounts located on opposite side walls 54 of one segment 50. The axle 90 can snap into the mount 80 by pushing along arrow C, as shown in FIG. 9, which then restrains the axle 90 from translation by force "D" associated with neck 82 while still allowing the axle 90 to rotate. A plurality of wheels 95 are affixed to the axle 90. Thus, when wheel-axle assemblies are located in a plurality of mounts 80 of adjacent interconnected blocks 10 a structure similar to a car or train can be created, as shown in FIG. 16.

Figure 13:
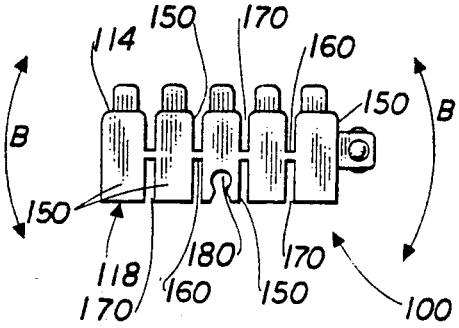
FIG. 13 is a front view of the FIG. 1 single block according to an alternative embodiment.
Figure 15:
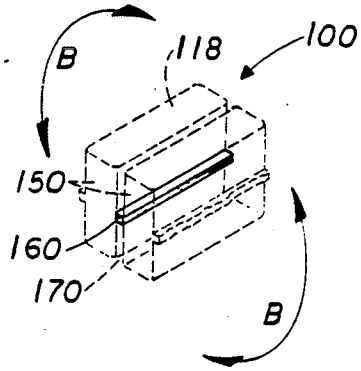
FIG. 15 is an exemplary isometric view of a portion of the FIG. 13 alternative embodiment block revealing an illustrative block flexibility means.

Referring now to FIGS. 13 and 15, a secondary block 100 is shown. The secondary block 100 has interconnection features similar to those described above in connection with the primary block 10 including an axle mount 180 similar to axle mount 80 shown in FIG. 9. The secondary block 100 has a vertical flexing means for bending about the horizontal axis Y similar to that described hereinabove (e.g. FIG. 4) in connection with the primary block 10. However, an additional vertical flexing means is provided. Each gap 170 is intersected by a horizontal web 160 which connects adjacent segments 150 together.

When vertical flexing forces are applied in a similar way as along arrow B, shown in FIGS. 3, 13 and 15, the gaps 170 are deformed from having a rectangular cross-section when viewed from the side to having a triangular cross-section. This flexing means is restrained by the bottom surfaces 118 or top surfaces 114 of adjacent segments 150 coming into contact with each other. In use and operation, the secondary block 100 tends to resist flexing within a horizontal plane but has multiple such flexing means within a vertical plane. Various unique structures can be created by interconnection of multiple secondary blocks 100 and mixtures of the secondary blocks 100 with the primary blocks 10.

Figure 12:
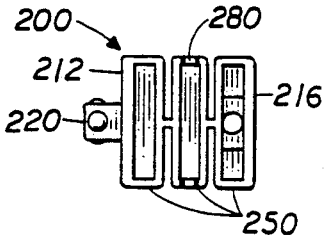
FIG. 12 is a bottom plan view of the FIG. 10 secondary block.
Figure 12A:
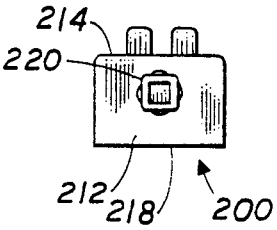
FIG. 12A is a left side view of the FIG. 10 secondary block showing a front end thereof.
Figure 12B:
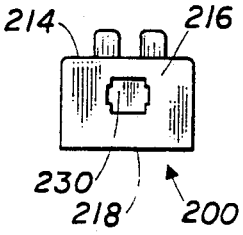
FIG. 12B is a right side view of the FIG. 10 secondary block showing a rear end thereof.

Referring now to FIGS. 10 through 12, 16 and 17, another block 200 is shown. Block 200 has flexing means identical to those described in detail hereinabove in connection with the primary blocks 10. Block 200 has a top surface 214 and a bottom surface 218 attachment means similar to that found on the primary block 10. The block 200 has a front end 212 with a projection 220 similar to that found on the primary block 10 (shown in FIG. 12A). The second rear end 216 of the block 200 has a receiver 230 (shown in FIG. 12B) similar to primary block 10. Preferably, the block 200 has only three segments 250. In use and operation, the block 200 can be interconnected with other blocks 200, primary blocks 10 and secondary blocks 100. Note that block 200 includes an axle mount 280 which is similar to the axle mount 80 (FIG. 3) and 180 (FIG. 13).

Also, as schematically depicted in FIG. 15, the end block 200 could have its web 160 oriented in either of the "horizontal" or "vertical" directions as was done in FIGS. 3 and 13.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A flexible toy building block having a top surface, a bottom surface, a first front end and a second rear end comprising in combination:

means for vertically stacking said building block to a similar building block, means for horizontally connecting said building block to a similar building block, and means for flexing said building block including means to pivot said first end into and out of a parallel orientation with said second end;

whereby a versatile building block is created which can be combined with other similar blocks in a multitude of unique and original ways, providing a medium for exercising creativity and improving various developmental skills of a user;

wherein said building block has side surfaces which include mounts therein, and wherein said building block includes an axle with wheels thereon, said mounts supporting said axle and restricting said axle from translation while allowing said axle and said wheels to rotate;

whereby said building block may be supported above a flat surface and moved thereon through rotation of said wheels fastened to said axle.

2. The building block of claim 1 wherein said vertical stacking means includes a top surface attachment means and a complemental bottom surface attachment means, whereby said bottom surface connects to said top surface when said building block is positioned above or below a similar building block; and wherein said flexing means includes a vertical flexing means and a horizontal flexing means.

3. The building block of claim 2 wherein said horizontal connecting means includes a first front end attachment means and a complemental second rear end attachment means, whereby said first front end connects to said second rear end when said building block is positioned in front of or behind a similar building block.

4. The building block of claim 3 wherein said top surface attachment means is complemental to said first front end attachment means, whereby said building block may be attached to a similar building block when said top surface of said building block is positioned adjacent to said first front end of a similar building block or when said first front end of said building block is positioned adjacent to said top surface of a similar building block.

5. A flexible toy building block having a top surface, a bottom surface, a first front end and a second rear end comprising in combination:

means for vertically stacking said building block to a similar building block, means for horizontally connecting said building block to a similar building block, and means for flexing said building block;

whereby a versatile building block is created which can be combined with other similar blocks in a multitude of unique and original ways, providing a medium for exercising creativity and improving various developmental skills of a user;

wherein said vertical stacking means includes a top surface attachment means and a complemental bottom surface attachment means, whereby said bottom surface connects to said top surface when said building block is positioned above or below a similar building block;

wherein said horizontal connecting means includes a first front end attachment means and a complemental second rear end attachment means, whereby said first front end connects to said second rear end when said building block is positioned in front of or behind a similar building block;

wherein said top surface attachment means is complemental to said first front end attachment means, whereby said building block may be attached to a similar building block when said top surface of said building block is positioned adjacent to said first front end of a similar building block or when said first front end of said building block is positioned adjacent to said top surface of a similar building block;

wherein said building block has side surfaces which include mounts therein, and wherein said building block includes an axle with wheels thereon, said mounts supporting said axle and restricting said axle from translation while allowing said axle and said wheels to rotate;

whereby said building block may be supported above a flat surface and moved thereon through rotation of said wheels fastened to said axle.

6. The building blocks of claim 5 wherein said flexing means includes means for flexing said building block about a first vertical axis and means for flexing said building block about a second horizontal axis, whereby said first front end of said building block may both pitch and yaw with respect to said second rear end.

7. The building block of claim 6 wherein said top surface attachment means of said vertical stacking means is a plurality of uniformly shaped square posts, and wherein said bottom surface attachment means of said vertical stacking means is a plurality of rectangular rims, said posts being of similar width to the width of said rims, said posts being arrayed in rows spaced an equal distance apart as the distance between adjacent said rims;

whereby each of said rows of said posts on said top surface of said building block may fit within said rims of said bottom surface of an adjoining similar building block, and whereby each of said rims of said bottom surface of said building block may fit over said rows of said posts of said top surface of an adjoining similar building block.

8. The building block of claim 7 wherein said first front end attachment means of said horizontal connecting means is a square cross-sectioned projection extending outwardly orthogonally from said front end of said building block, said projection having detents on side surfaces thereof circumscribing said projection, and wherein said second rear end attachment means of said horizontal connecting means is a substantially square receiver of similar cross-section as said projection, said receiver being a hole formed in said second rear end of said building block, and said receiver having recesses within said receivers of complemental size to said detents of said projection, located a distance from said second rear end equal to the distance from said first front end to said detents;

whereby said detents can reside within said recesses when said projection is positioned within said receiver, thereby holding said projection of said building block securely within said receiver of a similar adjoining building block.

9. The building block of claim 8 wherein said projection has a square cross-sectioned hollow interior, said interior being sized to receive one of said posts of said top surface attachment means;

whereby one of said posts of said building block may be connected within said interior of said projection of said first front end of an adjoining similar building block.

10. The building block of claim 9 wherein said first vertical axis flexing means is a plurality of gaps intersecting said building block in a plurality of planes orthogonal to a long axis of said building block, said gaps dividing said building block into a plurality of segments, each of said segments connected to each other by a plurality of vertical webs intersecting each of said gaps, said vertical webs being substantially planar thin rectangular constructs having a long axis extending from said bottom surface of said building block to said top surface of said building block;

whereby when bending forces are applied to said building block about the first vertical axis, side walls of said segments on one side of said building block can move closer together by reducing the width of said gaps, and side walls of said segments on another side of said building block may move farther apart by increasing the width of said gaps, causing said gaps to be transformed from having a rectangular cross-section to having a wedge-shaped cross-section.

11. The building block of claim 10 wherein said second horizontal axis flexing means is a blind bore formed on the bottom of each of said segments making said segments hollow, said blind bores being substantially orthorhombic in shape and fixed at a constant width on an upper surface thereof by said top surfaces of each of said segments and said blind bores not being restricted in width on said bottom surface thereof;

whereby when bending forces are applied to said building block about the second horizontal axis, inside walls of said segments are forced together on lower ends thereof causing the width of said blind bores on said bottom surface to be reduced while the width of an upper end of said blind bores next to said top surface is held constant.

12. A flexible toy building block having a top surface, a bottom surface, a first front end and a second rear end comprising in combination:

means for vertically stacking said building block to a similar building block, means for horizontally connecting said building block to a similar building block, and means for flexing said building block about a first axis and means for flexing said building block about a second axis which is perpendicular to the first axis;

wherein said means for flexing said block about said first axis is a plurality of gaps intersecting said flexible block in a plurality of spaced, parallel planes, each gap orthogonal to a third axis of said flexible block which is perpendicular to both the first axis and the second axis, said gaps dividing said flexible block into a plurality of segments which also extend in spaced, parallel planes orthogonal to the third axis, each of said segments connected to adjacent said segments by a web intersecting each of said gaps, each said web being substantially a planar rectangular construct which extends in a plane orthogonal to the second axis;

whereby when bending forces are applied to said flexible block about the first axis, side walls of said segments orthogonal to the second axis on one side of said flexible block can move closer together by reducing the width of said gaps, and side walls of said segments orthogonal to the second axis on an opposite parallel side of said flexible block can move further apart by increasing the width of said gaps, thereby causing said flexible block to bend about the first axis;

whereby a versatile building block is created which can be combined with other similar blocks in a multitude of unique and original ways, providing a medium for exercising creativity and improving various developmental skills of a user.

13. A single polygonal flexible toy block having a substantially orthorhombic structure comprising in combination:

means for flexing said block about a first axis and means for flexing said block about a second axis integrally formed with said block, said second axis perpendicular to said first axis, and means for interconnecting said flexible block to a similar flexible block;

whereby a block is created which can flex in a variety of unique ways and interconnect with other similar blocks to provide the user with a toy for education and amusement;

wherein said means for flexing said block about said first axis is a plurality of gaps intersecting said flexible block in a plurality of spaced, parallel planes, each gap orthogonal to a third axis of said flexible block which is perpendicular to both the first axis and the second axis, said gaps dividing said flexible block into a plurality of segments which also extend in spaced, parallel planes orthogonal to the third axis, each of said segments connected to adjacent said segments by a web intersecting each of said gaps, each said web being substantially a planar rectangular construct which extends in a plane orthogonal to the second axis;

whereby when bending forces are applied to said flexible block about the first axis, side walls of said segments orthogonal to the second axis on one side of said flexible block can move closer together by reducing the width of said gaps, and side walls of said segments orthogonal to the second axis on an opposite parallel side of said flexible block can move further apart by increasing the width of said gaps, thereby causing said flexible block to bend about the first axis.

14. The flexible block of claim 12 wherein said second axis flexing means is a blind bore formed on a bottom surface of each of said segments, making said segments hollow, said blind bores being substantially orthorhombic in shape and fixed at a constant width on an upper surface thereof by top surfaces of each of said segments and said blind bores not being restricted in width on said bottom surface thereof;

whereby when bending forces are applied to said flexible block about the second axis, inside walls of said segments are either forced together on lower ends thereof or forced apart on lower ends thereof, causing the width of said blind bores on said bottom surface to be reduced or expanded while the width of an upper surface of said blind bores next to said top surface is held constant.

15. The flexible block of claim 14 wherein said interconnecting means includes a first front end attachment means comprised of a projection formed with side surfaces and extending outwardly orthogonally from a first front end of said flexible block, said projection having detents on said side surfaces and circumscribing said projection; and a complemental second rear end attachment means comprised of a substantially square receiver of similar cross-section as said projection, said receiver being a substantially square hole formed in a second rear end of said flexible block and said receivers having recesses within said receivers of a complemental size to said detents of said projection located a distance from said second rear end equal to the distance from said first front end to said detents;

whereby said first front end can connect to said second rear end and said detents of said projection can reside within said recesses due to said projection being positioned within said receiver, thereby holding said projection of said flexible block securely within said receiver of an adjoining similar flexible block.

16. The flexible block of claim 15 wherein said interconnecting means includes a top surface attachment means comprised of a plurality of uniformly shaped substantially isometric posts extending upwardly therefrom, and a complemental bottom surface attachment means comprised of a plurality of rectangular rims on said bottom surface, said rims being of similar width to the width of said posts, said posts being arrayed in rows spaced an equal distance apart as the distance between adjacent said rims;

whereby said bottom surface connects to said top surface by having each of said rows of said posts on said top surface of said flexible block fit within said rims of said bottom surface of an adjoining similar flexible block, and whereby each of said rims of said bottom surface of said flexible block may fit over said rows of said posts of said top surface of an adjoining similar flexible block, and whereby said posts of adjacent said rows fit within said rims of said bottom surface of an adjoining similar block.

17. The flexible block of claim 16 wherein said projection has a square cross-sectioned hollow interior, said interior being sized to receive one of said posts of said top surface;

whereby one of said posts of said top surface of said flexible block can be connected within said interior of said projection of said first front end of an adjoining similar flexible block.

18. The flexible block of claim 17 wherein said flexible block has side surfaces which include axle mounts capable of receiving an axle which can support wheels, said axle mount restricting said axle from translation while allowing said axle and said wheels to rotate;

whereby said flexible block may be supported above a flat surface and moved thereon through rotation of said wheels fastened to said axle.

19. A set of interconnectable flexible blocks of similar construction comprising in combination:

means for interconnecting a series of said blocks together, and means for internally flexing said blocks;

whereby a series of said blocks can be formed into a chain through serial interconnection by a user allowing the user to create enjoyable structures from said blocks;

wherein a plurality of mounts are provided on said blocks including a plurality of axles which support a plurality of wheels, whereby when said blocks are interconnected in a set said wheels can provide a means for smooth translation of said set of blocks;

and wherein each of said blocks has both a horizontal flexing means and a vertical flexing means which together comprise said flexing means, whereby said blocks may be flexed alone or as an interconnecting set by utilizing said horizontal flexing means or said vertical flexing means to bend while remaining in a horizontal plane or in a vertical plane or by utilizing both said horizontal flexing means and said vertical flexing means to simultaneously bend into a variety of non-planar configurations.

20. The set of blocks of claim 19 wherein each of said blocks has both a horizontal flexing means and a vertical flexing means which together comprise said flexing means, whereby said blocks may be flexed alone or as an interconnecting set by utilizing said horizontal flexing means or said vertical flexing means to bend while remaining in a horizontal plane or in a vertical plane or by utilizing both said horizontal flexing means and said vertical flexing means to simultaneously bend into a variety of non-planar configurations.

21. The set of blocks of claim 19 wherein said horizontal flexing means is a plurality of gaps intersecting each of said blocks in a plurality of parallel planes, said gaps dividing each of said blocks into a plurality of planar segments which extend in parallel planes, each of said segments connected to adjacent said segments by a web intersecting each of said gaps, each said web being substantially a planar rectangular construct orthogonal to said segments and extending from a top surface of each of said blocks to a bottom surface of each of said blocks;

whereby when bending forces are applied to each of said blocks or to said set of blocks within a horizontal plane, side walls of said segments on one side of each of said blocks can move closer together by reducing the width of said gaps, and side walls of said segments on an opposite parallel side of each of said blocks can move further apart by increasing the width of said gaps, thereby causing each of said blocks or said set of blocks to bend within the horizontal plane;

and wherein said vertical flexing means is a blind bore formed on said bottom surface of each of said segments, making said segments hollow, said blind bores being substantially orthorhombic in shape and fixed at a constant width on an upper surface thereof by said top surface of each of said segments and said blind bores not being restricted in width on said bottom surface thereof;

whereby when bending forces are applied to each of said blocks or to said set of blocks within a vertical plane, side walls of said segments are either forced together on lower ends thereof or forced apart on lower ends thereof, causing the width of said blind bore on said bottom surface to be reduced or expanded while the width of an upper surface of said blind bore next to said top surface is held constant.

22. The set of blocks of claim 21 wherein each of said blocks has both a vertical stacking means and a horizontal connecting means which together comprise said interconnecting means, whereby individual said blocks can be connected to other individual said blocks to create block configurations which extend both vertically and horizontally.

23. The set of blocks of claim 22 wherein said vertical stacking means includes a top surface attachment means comprised of a plurality of uniformly shaped square posts and a complemental bottom surface attachment means comprised of a plurality of rectangular rims, said posts being of similar width to the width of said rims, said posts being arrayed in rows spaced an equal distance apart as the distance between adjacent said rims;

whereby each of said rows of said posts on said top surface of each of said blocks may fit within said rims of said bottom surface of adjoining said blocks, and whereby each of said rims of said bottom surface of each of said blocks may fit over said rows of said posts of said top surface of adjoining said blocks, thereby allowing said bottom surface to connect to said top surface when one of said blocks is positioned above or below another of said blocks;

and wherein said horizontal connecting means includes a first front end attachment means comprised of a square cross-sectioned projection extending outwardly orthogonally from said first front end of each of said blocks, said projection having detents on side surfaces thereof circumscribing said projection and a complemental rear end attachment means comprised of a substantially square receiver of similar cross section as said projection, said receiver being a substantially square hole formed in a second rear end of each of said blocks, and said receiver having recesses within said receiver of a complemental size to said detents of said projection, located a distance from said second rear end equal to the distance from said first front end to said detents;

whereby said detents of said projection can reside within said recesses when said projection is positioned within said receiver, thereby holding said projection of each of said blocks securely within said receiver of adjoining said blocks, and thereby allowing said first front end to connect to said second rear end when one of said blocks is positioned in front of or behind another of said blocks.

24. The set of blocks of claim 22 wherein an end block is provided having said projection on said first front end connectible to said receivers of adjacent said blocks and to said posts of adjacent said blocks, and having a second rear end capable of interconnection to adjacent said end blocks.

25. The set of blocks of claim 24 wherein a secondary block is provided similar to said blocks wherein each said web is placed ninety degrees offset from said blocks, whereby said set of blocks is provided with a flexibility gradient between a vertical plane and a horizontal plane.

* * * * *